US006658682B1

(12) United States Patent
Wells

(10) Patent No.: US 6,658,682 B1
(45) Date of Patent: Dec. 9, 2003

(54) BEDDING OR SEATING PRODUCT WITH SPRING CORE TOPPER

(75) Inventor: Thomas J. Wells, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 77 days.

(21) Appl. No.: 09/557,509

(22) Filed: Apr. 25, 2000

(51) Int. Cl.[7] ..... A47C 23/04
(52) U.S. Cl. ..... 5/655.7; 5/716; 5/727
(58) Field of Search ..... 5/716, 740, 655.7, 5/727, 654.1, 936, 720; 267/91, 94, 142, 143

(56) References Cited

U.S. PATENT DOCUMENTS

| | | | | |
|---|---|---|---|---|
| 871,871 A | | 11/1907 | Hirschman | |
| 1,359,120 A | | 11/1920 | Smith et al. | |
| 1,880,137 A | | 11/1932 | Hilton | |
| 2,047,667 A | | 7/1936 | Braun | |
| 2,264,607 A | * | 12/1941 | Asaro | 267/92 |
| 2,348,897 A | | 5/1944 | Gladstone | |
| 3,462,779 A | * | 8/1969 | Thompson | 5/655.7 |
| 3,493,980 A | * | 2/1970 | Haller | 5/716 |
| 3,684,270 A | | 8/1972 | Earle | |
| 3,950,800 A | | 4/1976 | Garshfield | |
| 4,180,877 A | | 1/1980 | Higgins | |
| 4,867,423 A | | 9/1989 | Marsh | |
| 5,127,635 A | * | 7/1992 | Long et al. | 267/91 |
| 5,713,088 A | | 2/1998 | Wagner et al. | |
| 6,009,579 A | | 1/2000 | Pedersen | |
| 6,023,803 A | | 2/2000 | Barman | |
| 6,128,798 A | * | 10/2000 | Barman et al. | 5/716 |

* cited by examiner

*Primary Examiner*—Heather Shackelford
*Assistant Examiner*—Frederick Conley
(74) *Attorney, Agent, or Firm*—Wood, Herron & Evans, L.L.P.

(57) ABSTRACT

A bedding or seating product comprising a base and a topper located above the base, the base and topper being surrounded in an upholstered covering. In one embodiment, the topper comprises a plurality of parallel continuous bands of springs, each of said bands being made of one piece of wire. In another embodiment, the topper is posturized with coil spring segments and filler segments. The segments may extend from side to side or be arranged in numerous other configurations.

30 Claims, 6 Drawing Sheets

BEDDING OR SEATING PRODUCT WITH SPRING CORE TOPPER

FIELD OF THE INVENTION

The present invention relates to bedding or seating products and more particularly to a bedding or seating product having a topper resting on a base.

BACKGROUND OF THE INVENTION

Bedding or seating products comprising an array of coil springs for years have been covered with a padding and wrapped in an upholstery material. The padding located on the top of the spring core of the bedding or seating product may be made of numerous material including but not limited to pieces of foam. For example, U.S. Pat. No. 6,023,803 utilizes a high density, high Indentation Load Deflection (ILD) convoluted polyurethane foam topper as a transition layer between the top of the spring core and the upholstery surrounding the mattress. Such a topper may cover only one side of the spring core or both sides of the spring core as in the mattress disclosed in U.S. Pat. No. 6,023,803. A two-sided mattress such as the one disclosed in U.S. Pat. No. 6,023,803 has an identical feel on both sides and may be used accordingly.

Another type of topper commonly used in bedding or seating products is a topper which is removable from the bedding or seating product. Such a topper is disclosed in U.S. Pat. No. 6,009,579. This patent discloses a down-filled topper member which is secured to a featherbed below it with straps. Such removable toppers have also been known to be used with mattresses or bedding products having an innerspring core.

Seating products have been developed which have a topper covering a spring core, the topper having a plurality of springs incorporated therein. Such toppers have been used in seat cushions in order to soften or cushion the load placed on the cushion. U.S. Pat. No. 2,264,607 discloses a seat cushion with an innerspring topper located above a base, the base comprising a plurality of individually pocketed coil springs. The topper disclosed in this patent comprises a top piece of fabric and a bottom piece of fabric sewn together around the periphery of the topper with individually pocketed coil springs between the pieces of fabric. The springs used in this topper are of a substantially lighter gauge wire than the springs of the base of the cushion in order to provide a yielding initial soft surface when one sits on the cushion. Although this patent discloses a topper comprising a plurality of pocketed coil springs incorporated therein, the topper has a uniform construction throughout and therefore imparts a uniform degree of firmness to the user.

Consequently, it has been one objective of the present invention to provide a posturized topper for use in a bedding or seating product, the topper having a plurality of coil springs incorporated therein to impart differing degrees of firmness to different regions of the bedding or seating product.

It has further been an objective of the present invention to provide a bedding or seating product having a topper incorporating a plurality of continuous bands of coil springs held together with helical lacing wires.

It has further been an objective of the present invention to provide a bedding or seating product having a topper comprising alternating sections of filler and sections of springs in order to impart different degrees of firmness to different regions of the product.

SUMMARY OF THE INVENTION

The invention of this application which accomplishes these objectives comprises a bedding or seating product having a base and a topper located above the base, the topper and base being surrounded in an upholstered covering. In one preferred embodiment of the present invention, the topper comprises a plurality of parallel bands of coil springs held together with helical lacing wires. The bands of coil springs may extend longitudinally from end to end of the product, or alternatively from side to side, transversely. In this preferred embodiment, the topper covers the entire upper surface of the base of the bedding or seating product.

The base of the bedding or seating product may comprise a plurality of individually pocketed coil springs, a plurality of unpocketed springs or any other similar structure. In one preferred embodiment of the present invention, the topper rests directly on top of the fabric encasing the pocketed coil springs of the base. Because the springs of the base are individually pocketed, "noise" or spring-to-spring contact between the springs of the topper and the springs of the base is avoided.

In another preferred embodiment of the present invention, an insulator pad is located between the base and the topper in order to prevent spring-to-spring contact which creates "noise." Such an insulator pad may be connected to the coil springs of the base with hog rings or any other type of fastener. Additionally, the insulator pad may be connected to the bands of springs of the topper with hog rings, other types of fasteners, adhesive or other type of bonding material. Such a connection between the base, the insulator pad and the topper prevents the topper from moving relative to the base and the base from moving relative to the topper.

In yet another preferred embodiment of the present invention, the topper is posturized, i.e., has different degrees of firmness in different regions thereof. This embodiment of topper provides increased support in the lumbar or lower back region of a bedding product which has an increased load relative to the head and leg regions of the product. The topper has at least one spring core segment and at least one filler segment. Each spring core segment comprises a plurality of springs joined together. The springs may be parallel continuous bands of coil springs or individual springs. Each filler segment preferably comprises a piece of foam which may be polyurethane foam, latex foam or polyurethane foam impregnated with latex. Alternatively each filler segment may be a piece of fibrous material, a bladder filler with air or water or any other structure. The topper is divided into regions or zones, each region or zone comprising one filler segment or one spring core segment. The regions or zones are arranged to alternate as they extend from front to back of the bedding or seating product.

In an additional preferred embodiment of the present invention, the topper which rests upon the base comprises a generally rectangular spring core segment and a filler segment surrounding the spring core segment.

In yet another preferred embodiment, the topper comprises a generally rectangular filler segment centrally located and spring core segment surrounding the filler segment. In each of these last two preferred embodiments the base and topper are surrounded with an upholstered covering.

DETAILED DESCRIPTION OF THE DRAWINGS

Figure 1:
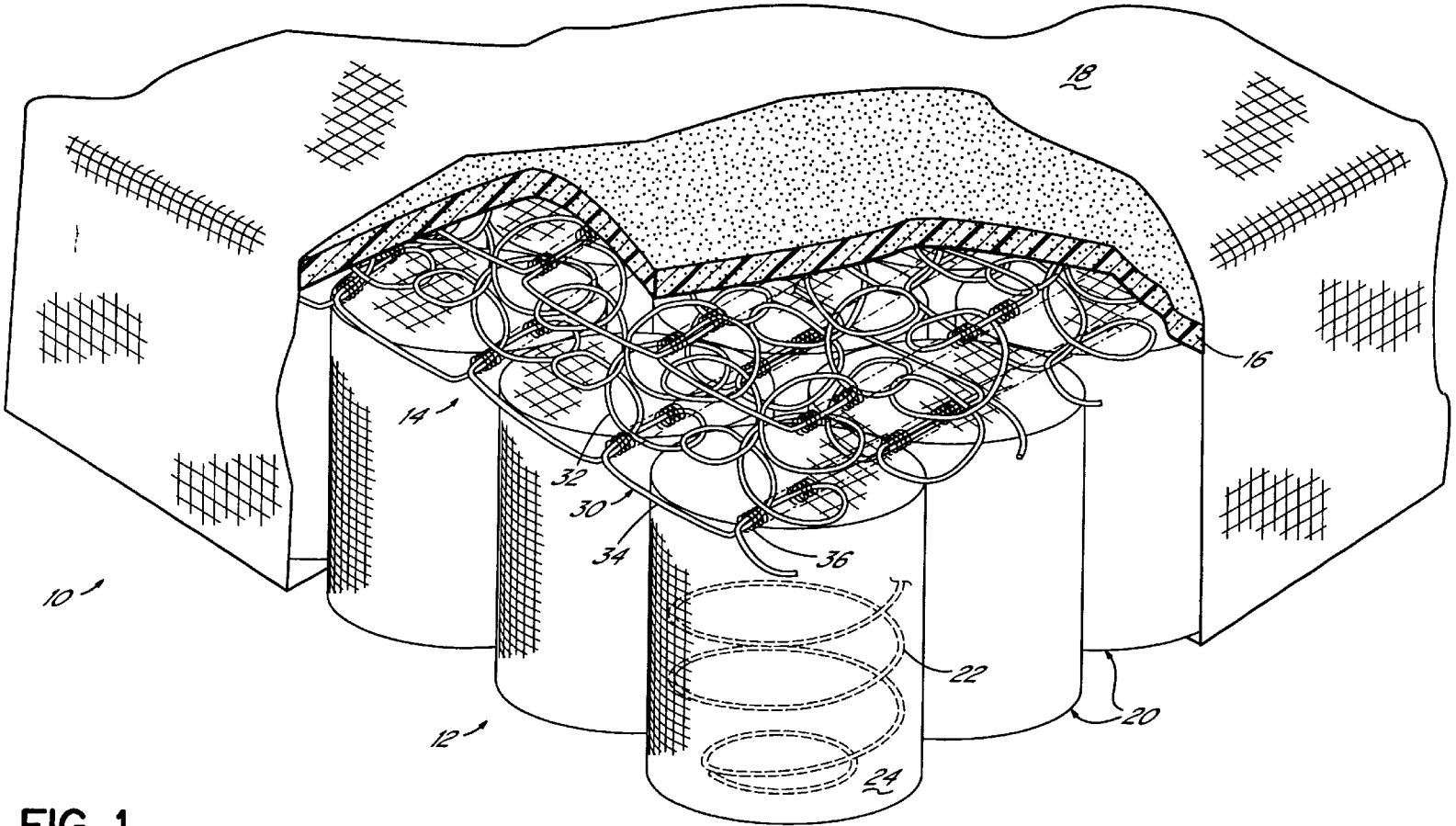
FIG. 1 is a perspective view of a portion of a bedding or seating product made in accordance with the present invention.

Referring to the drawings and particularly to FIG. 1, there is illustrated a bedding or seating product 10. The bedding or seating product comprises a base 12, a topper 14, padding 16 and an upholstered covering 18. The topper 14 rests on top of the base 12 with the padding 16 being located directly above the topper 14. The upholstered covering 18 surrounds the base 12, the topper 14 and the padding 16.

The base 12 is illustrated in FIG. 1 as being a plurality of individually pocketed springs 20, each individually pocketed spring 20 comprising a coil spring 22 encased in a fabric covering 24. For purposes of simplicity, in FIG. 1 only a portion of one coil spring 22 is shown in one pocket 20. However, it is understood that each of the individual pockets 20 has a coil spring 22 therein. A plurality of pocketed coil springs 20 may be joined together in strings of springs as is conventional in the art or may be joined individually as is known in the art as well.

Figure 1A:
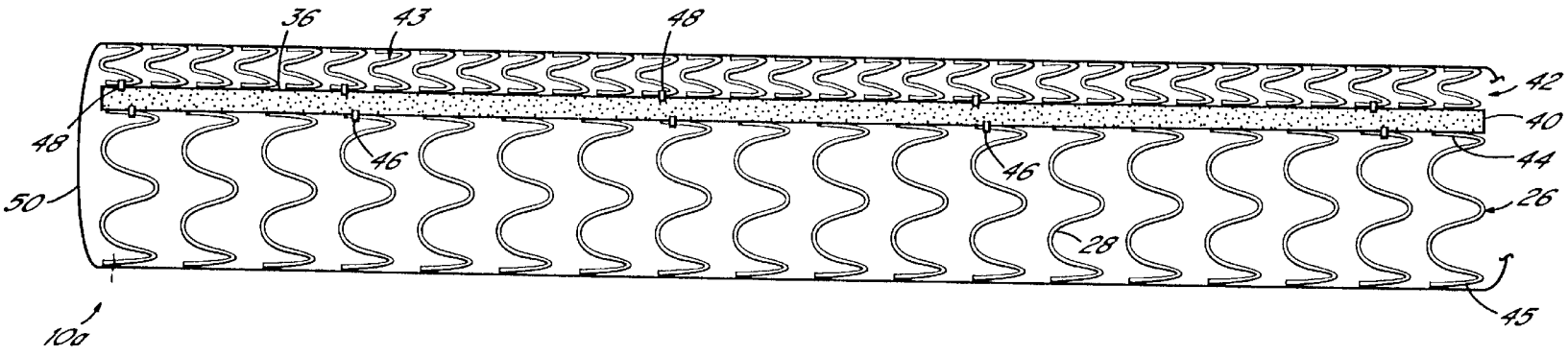
FIG. 1A is schematic side elevational view of an alternative embodiment of the bedding or seating product of the present invention, the product having an insulator pad between a base and a topper.

Although individually pocketed springs 20 are shown as making up the base 12, the base 12 may be made of numerous other materials including, but not limited to, a spring core made of unpocketed conventional springs. FIG. 1A illustrates a base 26 comprising a plurality of conventional coil springs 28 held together. In each of the embodiments of the present invention, the base may be plurality of pocketed springs, unpocketed conventional springs, bands of springs or other spring cores. This application is not intended to limit the configuration of the base used in the bedding or seating product of the present invention.

Referring back to FIG. 1, the topper 14 comprises a plurality of parallel continuous bands 30 of coil springs 32. Each band 30 is made of one piece of wire formed into coil springs 32 connected with connecting segments 34, as is conventional. Although the bands 30 of coil springs 32 are illustrated in FIG. 1 as extending longitudinally from front to back of the bedding or seating product, such bands may be transversely oriented so that they run from side to side (transversely). Adjacent bands 30 of coil springs 32 are held together with helical lacing wires 36. The helical lacing wires 36 extend perpendicular to the direction of the bands 30 of coil springs 32 so as to join together multiple bands in a parallel fashion as is conventional. Other connectors other than helical lacing wires may be used to join multiple bands 30 together to form a topper 14.

Referring to FIG. 1A, an alternative embodiment of bedding or seating product 10*a* is illustrated. This embodiment has a base 26 made up of a plurality of individual unpocketed coil springs 28 arranged in rows and columns into a matrix as is conventional. Each of the coil springs 28 has an upper end turn 44 and a lower end turn 45. In this embodiment in order to prevent "noise" or spring-to-spring contact, an insulator pad 40 is placed between upper end turns 44 of the coil springs 38 of the base 26 and a topper 42. The insulator pad may be made from numerous types of fibrous materials, non-fibrous material or any other cushioning material. The upper end turns 44 of the coil springs 28 of the base 26 are secured to the insulator pad 40 with hog rings 46 but may be secured in any fashion to the insulator pad 40. Similarly, hog rings 48 may be used to secure the topper 42 to the insulator pad 40. Alternatively, the topper may be adhesively secured to the upper surface 41 of the insulator pad 40. Other methods of attaching either the base 26 or the topper 42 to the insulator pad 40 may be utilized as well. The topper 42 comprises a plurality of continuous bands 43 of coil springs like those illustrated in FIG. 1. An upholstered covering 50 surrounds the topper 42 and the base 26 as is conventional.

Although the bedding or seating product 10*a* illustrated in FIG. 1A is the only embodiment illustrated as having an insulator pad located between the topper 42 and the base 26, any of the embodiments disclosed in this application may have an insulator pad located between the topper and the base. For example, there may be an insulator pad located between the topper 14 and the base 12 of the embodiment illustrated in FIG. 1 even though the base 12 comprises a plurality of pocketed coil springs 20.

Figure 2A:
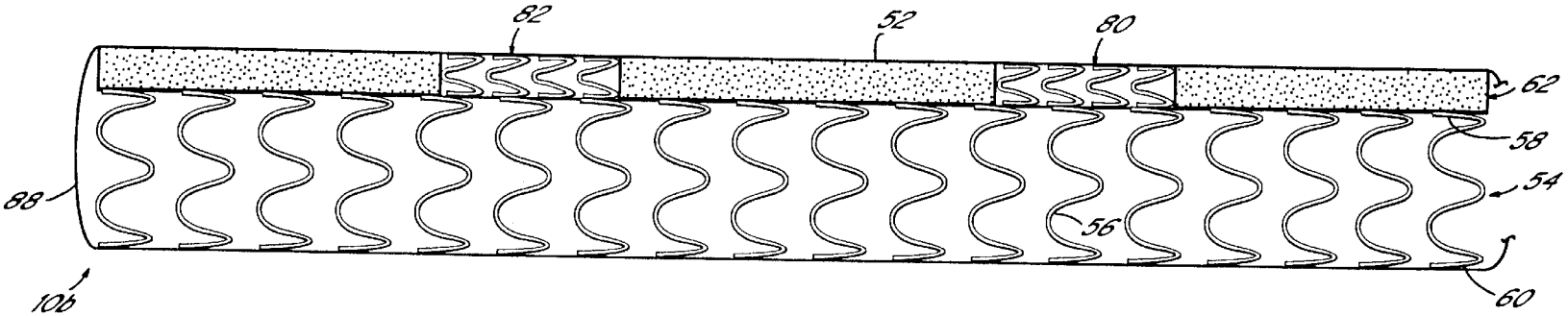
FIG. 2A is side elevational view of the bedding product illustrated in FIG. 2.
Figure 2:
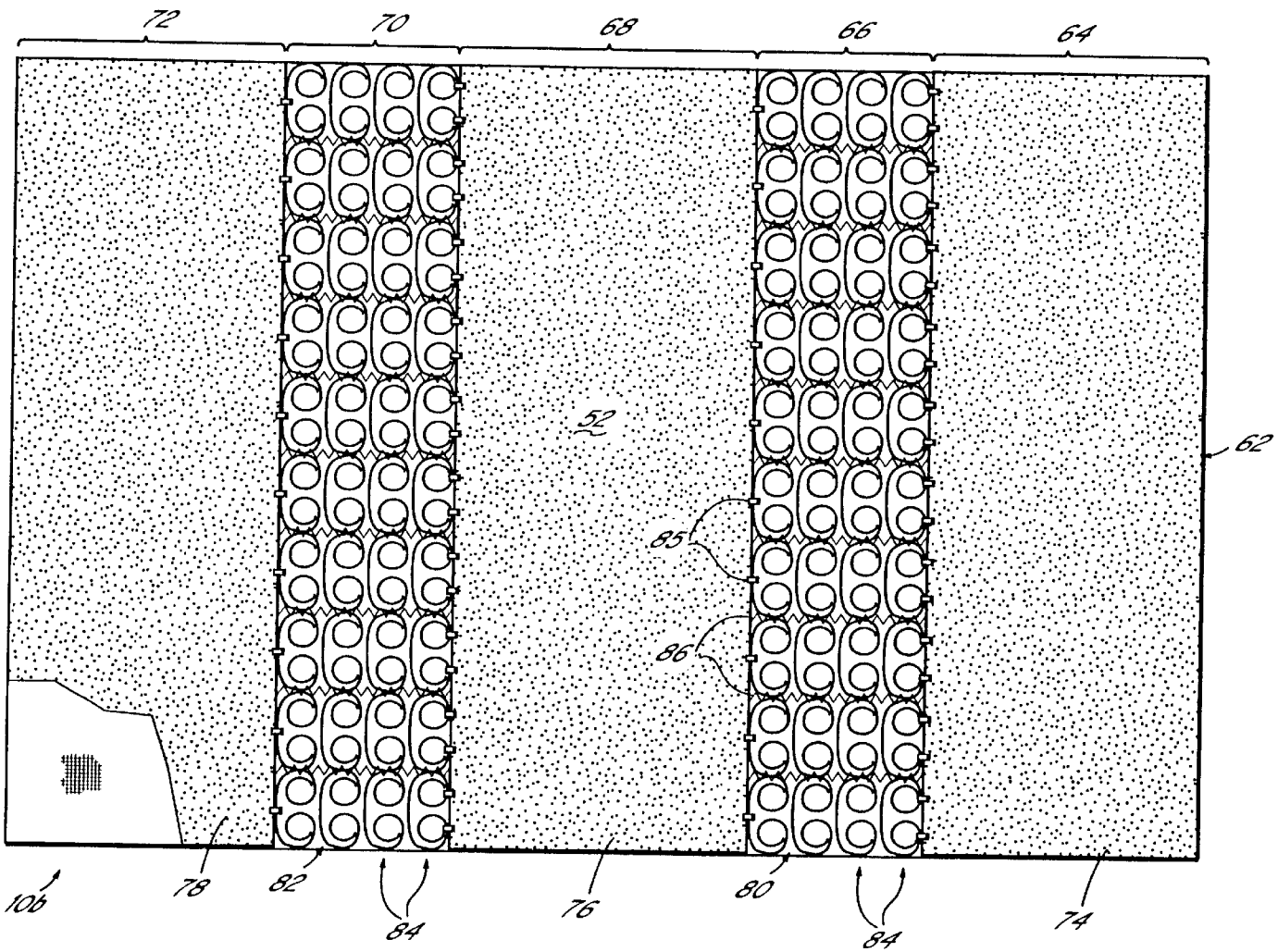
FIG. 2 is a top view of another preferred embodiment of the present invention utilizing a posturized topper comprising segments of filler and segments of springs.

Referring to FIGS. 2 and 2A, there is illustrated an alternative embodiment of bedding or seating product 10*c* of the present invention.

FIG. 2 illustrates the upper surface 52 of the bedding product 10*c* illustrated in FIG. 2A. This product 10*c* comprises a base 54 made up of a plurality of coil springs 56, each coil spring 56 having an upper end turn 58 and a lower end turn 60 as is conventional. A topper 62 rests upon the upper end turns 58 of the coil springs 56 of the base 54. This topper 62 is posturized in order to provide increased firmness in select portions or regions of the topper. This is accomplished by joining together multiple segments of the topper, each segment having its own characteristics so as to impart differing degrees of firmness to different sections or zones of the topper.

Moving from right to left as illustrated in FIG. 2 and 2A, the topper 62 is divided into a head section 64, an upper back section 66, a middle back section 68, a lower back section 70 and a foot section 72. The head, middle back and foot sections 64,68,72 are illustrated as being made of filler segments 74, 76 and 78, respectively. The upper and lower back sections 66,70 are each made of spring core segments 80 and 82, respectively. Each spring core segment 80,82 comprises a plurality of parallel bands 84 of coil springs, each band 84 extending from side to side, as best illustrated in FIG. 2. Adjacent bands 84 are connected with helical lacing wires 86. Although FIG. 2 illustrates four adjacent bands of springs in segments 80 and 82, any number of bands of springs may be used in a particular segment depending on the desired width of the section. Similarly, the size of any of the filler segments 74,76 or 78 may be varied depending on the desired application.

Although the spring core segments 80 and 82 illustrated in FIG. 2 are made up of a plurality of bands 84 of coil springs, such segments may be made of individual coil springs joined together. The coil springs of each segment in a posturized topper such as the one illustrated in FIGS. 2 and 2A need not be part of continuous bands of springs but may be any springs having the desired firmness.

Because the spring core segments 80,82 are firmer than the filler segments 74,76,78, the lower and upper back sections 70,66 of the topper 62 are firmer than the head, middle back and foot sections 64,68,72 of the topper, thus resulting in a posturized topper. Although one specific configuration of topper is illustrated having three filler segments and two spring core segments, the topper of the present invention may have any number of spring core segments of any size and any number of filler segments of any size in order to provide the desired posturization. As illustrated in FIG. 2A, the topper 62 and the base 54 are covered in an upholstered covering 88.

The different filler segments 74,76,78 may be joined to the spring core segments 80,82 with hog rings 85 or any other mechanical fasteners or adhesively secured together. Other fastening methods or devices may be used as well to connect the different segments of the topper.

Figure 3:
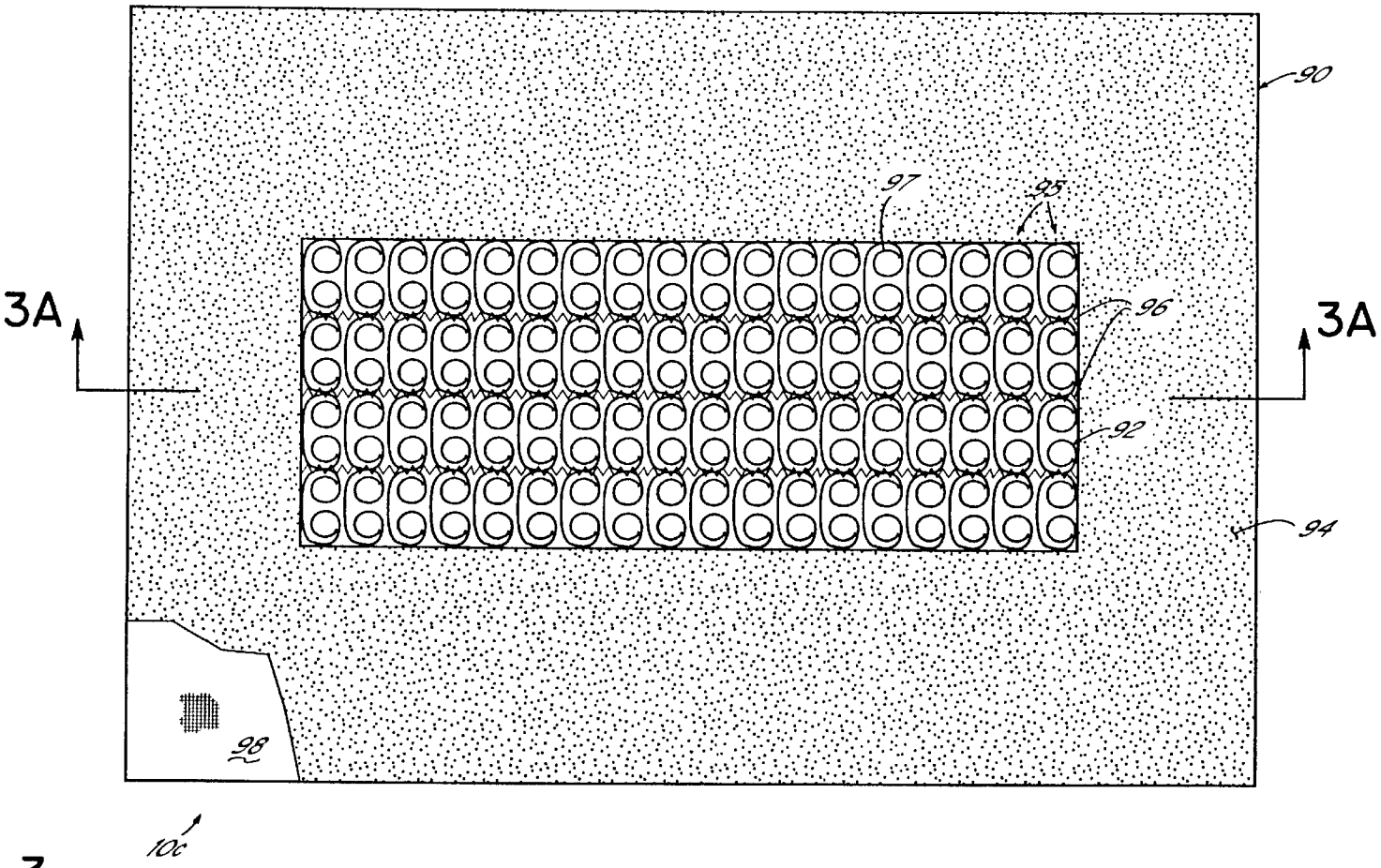
FIG. 3 is a top schematic view of yet another preferred embodiment of bedding or seating product made in accordance with the present invention.
Figure 3A:
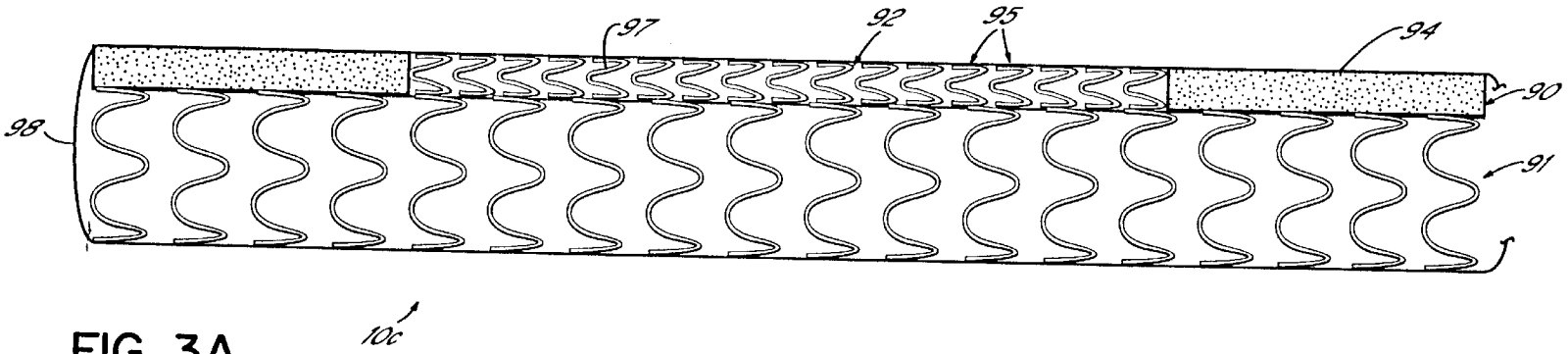
FIG. 3A is a cross-sectional view taken along the line 3A—3A of FIG. 3.

FIGS. 3 and 3A illustrate an alternative preferred embodiment of the present invention 10*d*. As illustrated in FIG. 3A, the bedding product 10*d* comprises a topper 90 above a base 91. The topper 90 comprises a generally rectangular spring core segment 92 and a filler segment 94 surrounding the spring core segment 92. The spring core segment 92 comprises a plurality of bands 94 of coil springs extending from side to side and joined together with helical lacing wires 96. Although the bands of coil springs are illustrated as extending from side to side, the bands may extend from front to back as well. Individual coil springs rather than bands of coil springs may also be utilized in the spring core segment 92. Any type of coil springs secured together using any of numerous methods may be used in the spring core segment 92. An upholstered covering 98 (only a portion of which is shown in FIG. 3) surrounds the topper 90 and the base 91.

Figure 4A:
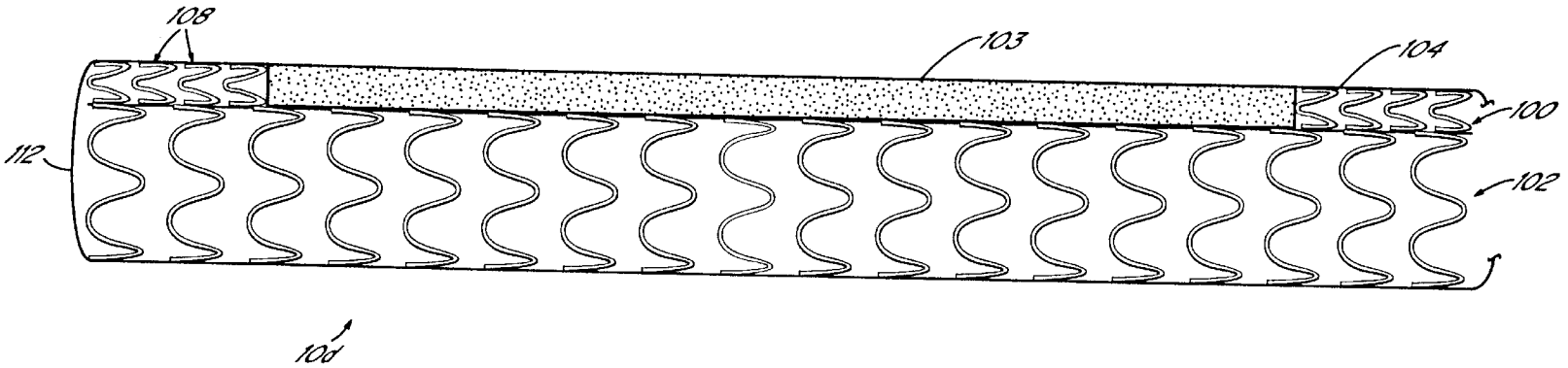
FIG. 4A is a cross-sectional view taken along the line 4A—4A of FIG. 4.
Figure 4:
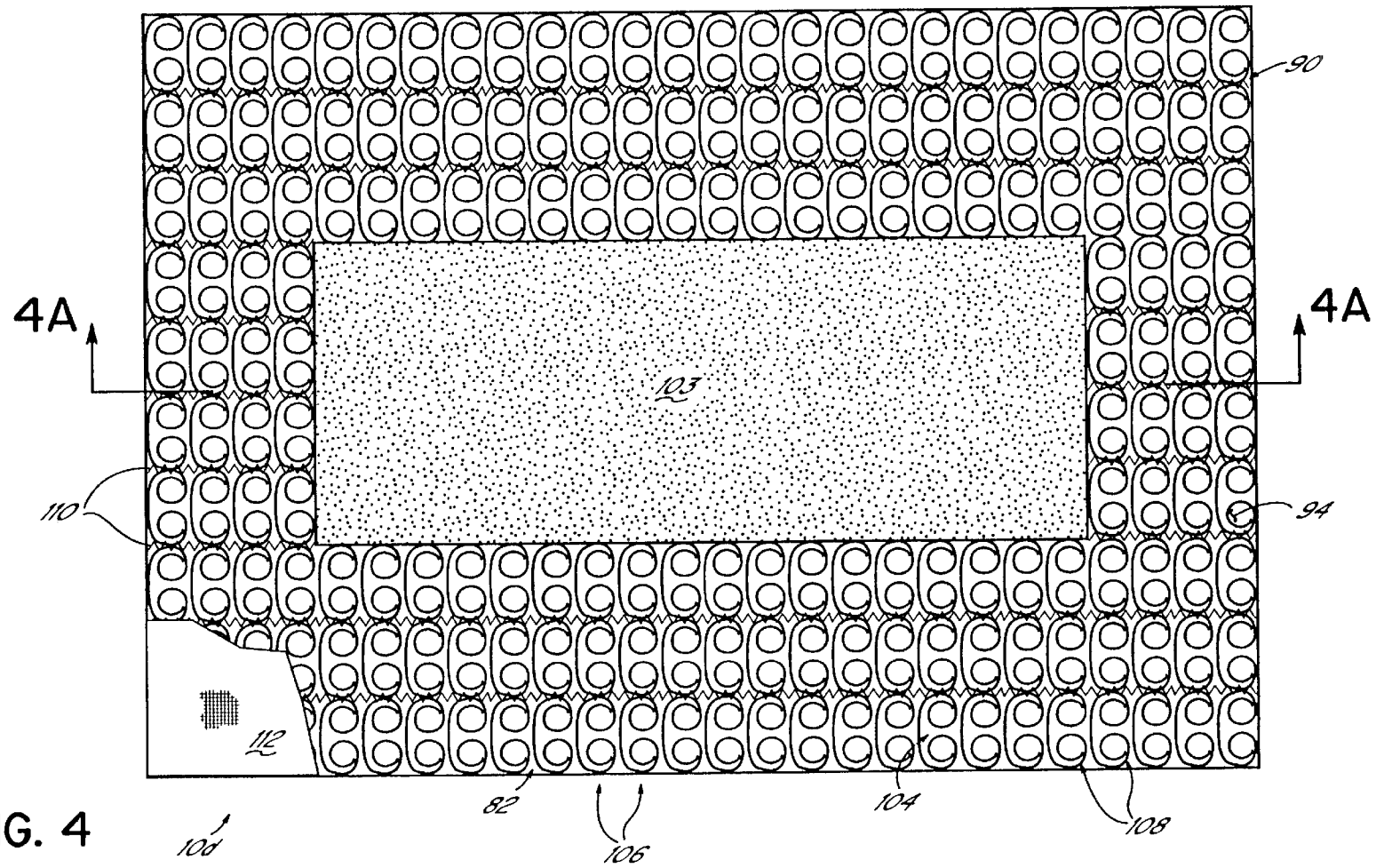
FIG. 4 is a is a top view of another preferred embodiment of the present invention.

FIGS. 4 and 4A illustrate an alternative preferred embodiment of the present invention 10*e*. In the bedding product 10*e*, a topper 100 rests above a base 102 (see FIG. 4A). The topper 100 comprises a generally rectangular filler segment 102 and a spring core segment 104 surrounding the foam segment 102. The spring core segment 104 comprises a plurality of bands 106 of coil springs 108 extending from side to side and joined together with helical lacing wires 110. Although the bands 106 of coil springs 108 are illustrated as extending from side to side, the bands 106 may extend from front to back as well. An upholstered covering 112 (only a portion of which is shown in FIG. 4) surrounds the topper 100 and the base 102.

While I have described several preferred embodiments of the present invention, those skilled in the art will appreciate changes and modifications which can be made to the present invention without departing from the scope of the present invention. Therefore, I intend to be limited only by the scope of the following claims.

I claim:

1. A bedding or seating product comprising:

a base, a topper located above said base, said topper comprising a plurality of parallel continuous bands of coil springs joined together, each of said bands of springs being made of one piece of wire formed into multiple coil springs and connecting segments joining said coil springs; and an upholstered covering surrounding said topper and said base.

2. The bedding or seating product of claim 1 wherein said continuous bands of coil springs are held together with helical lacing wires.

3. The bedding or seating product of claim 1 wherein said base comprises a plurality of springs.

4. The bedding or seating product of claim 1 wherein said base comprises a plurality of pocketed springs.

5. The bedding or seating product of claim 1 further comprising an insulator pad located between said base and said topper.

6. The bedding or seating product of claim 5 wherein said insulator pad is connected to said base and said topper.

7. The bedding or seating product of claim 6 wherein said insulator pad is connected to said base with hog rings.

8. The bedding or seating product of claim 6 wherein said insulator pad is connected to said topper with hog rings.

9. The bedding or seating product of claim 6 wherein said insulator pad and said topper are adhesively joined together.

10. A bedding or seating product comprising:

a base, a posturized topper located above said base, said topper having multiple sections of differing firmnesses including at least one spring core segment and at least one filler segment, each spring core segment comprising a plurality of parallel bands of coil springs joined together, each of said bands of coil springs being made of one piece of wire.

11. The bedding or seating product of claim 10 wherein said continuous bands of coil springs are joined together with helical lacing wires.

12. The bedding or seating product of claim 10 wherein said filler segments are foam segments.

13. The bedding or seating product of claim 10 wherein said topper is posturized by alternating said segments of said topper.

14. The bedding or seating product of claim 10 further comprising an insulator pad located between said base and said topper, said insulator pad being joined to at least one of said base and said topper.

15. The bedding or seating product of claim 14 wherein said insulator pad is joined to said base with hog rings.

16. The bedding or seating product of claim 14 wherein said insulator pad is joined to said topper with hog rings.

17. The bedding or seating product of claim 10 wherein said bands of coil springs extend from side to side of said product.

18. The bedding or seating product of claim 10 wherein each of said topper spring core segments and each of said topper filler segments extend from side to side.

19. The bedding or seating product of claim 10 wherein said topper has multiple spring core segments and multiple foam segments in order to posturize the product.

20. The bedding or seating product of claim 19 wherein said topper spring core segments and said topper filler segments are joined together.

21. A bedding or seating product comprising:

a base, a topper located above said base, said topper comprising a rectangular spring core segment and a filler segment surrounding said spring core segment, said spring core segment comprising a plurality of bands of coil springs joined together, each of said bands of coil springs being made of one piece of wire; and an upholstered covering surrounding said topper and said base.

22. The bedding or seating product of claim 21 wherein said filler segment is made of foam.

23. A bedding or seating product comprising:

a base, a topper located above said base, said topper comprising a rectangular spring segment and a spring core segment surrounding said filler segment, said spring core segment comprising a plurality of bands of coil springs joined together, each of said bands of coil springs being made of one piece of wire; and an upholstered covering surrounding said topper and said base.

24. The bedding or seating product of claim 23 wherein said filler segment is made of foam.

25. A bedding or seating product having a longitudinal dimension and a transverse dimension, said product comprising:

a base, a topper located above said base, said topper having at least one spring core segment and at least one filler segment, each spring core segment comprising a plurality of parallel, continuous bands of coil springs joined together, each of said bands of coil springs being made of one piece of wire formed into multiple coil springs and connecting segments joining said coil springs.

26. The product of claim 25 wherein each of said filler and spring core segments extends transversely.

27. The product of claim 25 wherein each of said filler and spring core segments extends longitudinally.

28. A bedding or seating product comprising:

a base comprising a plurality of pocketed coil springs, a topper located above said base, said topper having a plurality of spring core segments and a plurality of filler segments, each of said topper spring core segments comprising a plurality of springs joined together with helical lacing wires.

29. A bedding or seating product comprising:

a base, a posturized topper located above said base, said topper having multiple segments of differing firmnesses including a filler segment located between two topper spring core segments, each topper spring core segment comprising a plurality of springs joined together, each of said spring core segments being secured to said filler segment.

30. A bedding or seating product comprising:

a base, a posturized topper located above said base, said topper having multiple segments of differing firmnesses including a spring core segment located between two filler segments, each topper spring core segment comprising a plurality of springs joined together, each of said filler segments being secured to said spring core segment.

* * * * *

UNITED STATES PATENT AND TRADEMARK OFFICE

CERTIFICATE OF CORRECTION

PATENT NO. : 6,658,682 B1
DATED : December 9, 2003
INVENTOR(S) : Thomas J. Wells It is certified that error appears in the above-identified patent and that said Letters Patent is hereby corrected as shown below:

Title page,
Item [56], References Cited, U.S. PATENT DOCUMENTS, please add the heading -- FOREIGN PATENT DOCUMENTS --.
Beneath the heading, please insert -- 327105 3/1930 United Kingdom
426638 4/1935 United Kingdom --

Column 1,
Line 15, change "material" to -- materials --.

Column 3,
Line 1, change "is schematic" to -- is a schematic --.
Line 8, change "is side" to -- is a side --.
Line 16, change "4 is a is a" to -- 4 is a --.
Line 45, change "be plurality" to -- be a plurality --.

Column 4,
Line 34, the paragraph starting with "FIG. 2 illustrates" should be part of the preceding paragraph.
Line 47, change "FIG. 2 and 2A" to -- FIGS. 2 and 2A --.

Column 7,
Line 3, change "rectangular spring" to -- rectangular filler --.
Line 8, change "bands of coil springs being" to -- bands being --.

Signed and Sealed this

Sixteenth Day of March, 2004

JON W. DUDAS
*Acting Director of the United States Patent and Trademark Office*